US009725810B2

(12) United States Patent
Mizutani et al.

(10) Patent No.: US 9,725,810 B2
(45) Date of Patent: Aug. 8, 2017

(54) PLATING METHOD, PLATING APPARATUS AND STORAGE MEDIUM

(75) Inventors: Nobutaka Mizutani, Nirasaki (JP); Takashi Tanaka, Nirasaki (JP); Mitsuaki Iwashita, Nirasaki (JP)

(73) Assignee: TOKYO ELECTRON LIMITED, Tokyo (JP)

( * ) Notice: Subject to any disclaimer, the term of this patent is extended or adjusted under 35 U.S.C. 154(b) by 2 days.

(21) Appl. No.: 14/129,743

(22) PCT Filed: Jun. 20, 2012

(86) PCT No.: PCT/JP2012/065755

§ 371 (c)(1),
(2), (4) Date: Dec. 27, 2013

(87) PCT Pub. No.: WO2013/002096

PCT Pub. Date: Jan. 3, 2013

(65) Prior Publication Data

US 2014/0127410 A1 May 8, 2014

(30) Foreign Application Priority Data

Jun. 29, 2011 (JP) ..... 2011-144814

(51) Int. Cl.
*C23C 18/16* (2006.01)

(52) U.S. Cl.
CPC ..... *C23C 18/1689* (2013.01); *C23C 18/1619* (2013.01); *C23C 18/1669* (2013.01); *C23C 18/1675* (2013.01); *C23C 18/1676* (2013.01)

(58) Field of Classification Search
CPC ..... C23C 18/1619; C23C 18/1669; C23C 18/1675; C23C 18/1689
(Continued)

(56) References Cited

U.S. PATENT DOCUMENTS

2005/0095830 A1* 5/2005 Weidman ..... C23C 18/50 438/584
2006/0234508 A1 10/2006 Shirakashi
(Continued)

FOREIGN PATENT DOCUMENTS

JP 2001-073157 A 3/2001
JP 2004-15028 A 1/2004
(Continued)

OTHER PUBLICATIONS

International Search Report for PCT/JP2012/065755 dated Jul. 24, 2012.

*Primary Examiner* — Alexander Weddle
(74) *Attorney, Agent, or Firm* — Pearne & Gordon LLP

(57) ABSTRACT

A liquid displacement is performed by supplying a plating liquid onto a substrate 2 while rotating the substrate 2 at a first rotational speed in a state that a pre-treatment liquid remains on a surface of the substrate 2 (liquid displacement process (block S305)). Then, an initial film is formed on the substrate 2 by stopping the rotation of the substrate 2 or by rotating the substrate 2 at a second rotational speed while continuously supplying the plating liquid onto the substrate 2 (incubation process (block S306)). Thereafter, a plating film is grown by rotating the substrate 2 at a third rotational speed while continuously supplying the plating liquid onto the substrate 2 (plating film growing process (block S307)). Here, the first rotational speed is higher than the third rotational speed, and the third rotational speed is higher than the second rotational speed.

9 Claims, 7 Drawing Sheets

(58) Field of Classification Search
USPC ..... 427/437, 438; 118/52, 429, 697
See application file for complete search history.

(56) References Cited

U.S. PATENT DOCUMENTS

| | | | | |
|---|---|---|---|---|
| 2009/0253258 | A1* | 10/2009 | Hara et al. | 438/597 |
| 2010/0075027 | A1* | 3/2010 | Toshima | C23C 18/1628 427/123 |

FOREIGN PATENT DOCUMENTS

| | | | |
|---|---|---|---|
| JP | 2009-249679 | A | 10/2009 |
| JP | 4593662 | B2 | 12/2010 |

* cited by examiner

PLATING METHOD, PLATING APPARATUS AND STORAGE MEDIUM

CROSS-REFERENCE TO RELATED APPLICATION

This Application is a U.S. national phase application under 35 U.S.C. §371 of PCT Application No. PCT/JP2012/065755 filed on Jun. 20, 2012, which claims the benefit of Japanese Patent Application No. 2011-144814 filed on Jun. 29, 2011, the entire disclosures of which are incorporated herein by reference.

TECHNICAL FIELD

The embodiments described herein pertain generally to a plating method, a plating apparatus and a storage medium for performing a plating process by supplying a plating liquid onto a surface of a substrate.

BACKGROUND ART

In general, a wiring is formed on a substrate such as a semiconductor wafer or a liquid crystal substrate to form a circuit on a surface of the substrate. The wiring is typically made of, instead of aluminum, copper having low electric resistance and high reliability. Since, however, copper tends to be easily oxidized as compared to aluminum, it is required to plate a surface of the copper wiring with a metal having high electromigration resistance in order to suppress the surface of the copper wiring from being oxidized.

For example, a plating process is performed by supplying an electroless plating liquid onto the surface of the substrate on which the copper wiring is formed. Conventionally, such an electroless plating process is performed by a batch-type processing apparatus, in general. In the electroless plating process, in order to form a plating film by incurring an oxidation-reduction reaction in the vicinity of a surface of a wafer, it is desirable to stand the wafer without being shaken during the film forming process. For this reason, when performing the electroless plating process in the batch-type processing apparatus, a film forming rate of the plating film is controlled by adjusting a temperature of the plating liquid, a concentration of the plating liquid and a film forming time. Further, in consideration of the structure of the batch-type processing apparatus, even if it is attempted to move the wafer in the plating liquid, the wafer would be shaken only several centimeters. Thus, when the conventional batch-type processing apparatus is used, it may be difficult to improve a reaction rate of the plating liquid over a current level.

Patent Document 1: Japanese Patent Laid-open Publication No. 2009-249679

Patent Document 2: Japanese Patent Laid-open Publication No. 2001-073157

DISCLOSURE OF THE INVENTION

Problems to be Solved by the Invention

Meanwhile, as a single-wafer processing apparatus configured to perform an electroless plating process on wafers sheet by sheet, Japanese Patent Laid-open Publication No. 2009-249679 describes a plating apparatus including a substrate rotating device configured to rotate the substrate, a nozzle configured to discharge the plating liquid onto the substrate, and a nozzle moving device configured to move the nozzle along the substrate. In the plating apparatus described in Patent Document 1, by supplying the electroless plating liquid while rotating the substrate, a uniform flow of the plating liquid is formed on the surface of the substrate. As a result, a plating process is performed on the entire surface of the substrate uniformly.

Further, Japanese patent Laid-open Publication No. 2001-073157 describes a technique of repeating a chemical liquid coating process, a chemical liquid accumulating process and a chemical liquid removing process plural times in order to reduce an amount of the used chemical liquid. When forming a plating film having a thick thickness through this method, however, a processing time may be lengthened.

In view of the foregoing problems, the present example embodiment provides a plating method, a plating apparatus and a storage medium capable of reducing a plating time for a single substrate by improving a reaction rate of a plating liquid.

Means for Solving the Problems

In one example embodiment, a plating method performs a plating process by supplying a plating liquid onto a substrate. The plating method includes a liquid displacement process of performing a liquid displacement by supplying the plating liquid onto the substrate while rotating the substrate at a first rotational speed in a state that a pretreatment liquid remains on a surface of the substrate; an incubation process of forming an initial film on the substrate by stopping the rotation of the substrate or by rotating the substrate at a second rotational speed while continuously supplying the plating liquid onto the substrate; and a plating film growing process of growing a plating film by rotating the substrate at a third rotational speed while continuously supplying the plating liquid onto the substrate. Here, the first rotational speed is higher than the third rotational speed, and the third rotational speed is higher than the second rotational speed.

In another example embodiment, a plating apparatus performs a plating process by supplying a plating liquid onto a substrate. The plating apparatus includes a substrate holding/rotating device configured to hold and rotate the substrate; a discharging device configured to discharge the plating liquid toward the substrate held on the substrate holding/rotating device; a plating liquid supplying device configured to supply the plating liquid to the discharging device; and a controller configured to control the substrate holding/rotating device, the discharging device and the plating liquid supplying device. Further, the controller is configured to control the substrate holding/rotating device, the discharging device and the plating liquid supplying device to perform a liquid displacement by supplying the plating liquid onto the substrate from the discharging device while rotating the substrate at a first rotational speed through the substrate holding/rotating device in a state that a pretreatment liquid remains on a surface of the substrate; to form an initial film on the substrate by stopping the rotation of the substrate or by rotating the substrate at a second rotational speed through the substrate holding/rotating device while continuously supplying the plating liquid onto the substrate from the discharging device; and to grow a plating film by rotating the substrate at a third rotational speed through the substrate holding/rotating device while continuously supplying the plating liquid onto the substrate from the discharging device. Here, the first rotational speed is higher than the third rotational speed, and the third rotational speed is higher than the second rotational speed.

In yet another example embodiment, a computer-readable storage medium has stored thereon a computer-executable instructions that, in response to execution, cause a plating apparatus to perform a plating method of performing a plating process by supplying a plating liquid onto a substrate. Further, the plating method includes a liquid displacement process of performing a liquid displacement by supplying the plating liquid onto the substrate while rotating the substrate at a first rotational speed in a state that a pre-treatment liquid remains on a surface of the substrate; an incubation process of forming an initial film on the substrate by stopping the rotation of the substrate or by rotating the substrate at a second rotational speed while continuously supplying the plating liquid onto the substrate; and a plating film growing process of growing a plating film by rotating the substrate at a third rotational speed while continuously supplying the plating liquid onto the substrate. Here, the first rotational speed is higher than the third rotational speed, and the third rotational speed is higher than the second rotational speed.

In accordance with the example embodiment, in a state that a pre-treatment liquid remains on a surface of a substrate, a liquid displacement is performed by supplying a plating liquid onto the substrate while rotating the substrate at a first rotational speed (liquid displacement process). Subsequently, by stopping the rotation of the substrate or rotating the substrate at a second rotational speed while continuously supplying the plating liquid onto the substrate, an initial film is formed on the substrate (incubation process). Thereafter, by rotating the substrate at a third rotational speed while continuously supplying the plating liquid onto the substrate, a plating film is grown (plating film growing process). In this case, the first rotational speed is set to be higher than the third rotational speed, and the third rotational speed is set to be higher than the second rotational speed. In this way, by rotating the substrate at the third rotational speed while continuously supplying the plating liquid onto the substrate after the initial film is formed on the substrate, it is possible to displace the plating liquid, in which a concentration of reactive species is reduced, by a new plating liquid. As a result, stable growth of the plating film can be accelerated and a plating time for a single substrate can be shortened.

DETAILED DESCRIPTION

Hereinafter, an example embodiment will be described with reference to FIG. 1 to FIG. 8. First, referring to FIG. 1, an overall plating system 1 in accordance with the example embodiment will be elaborated.

(Plating System)

Figure 1:
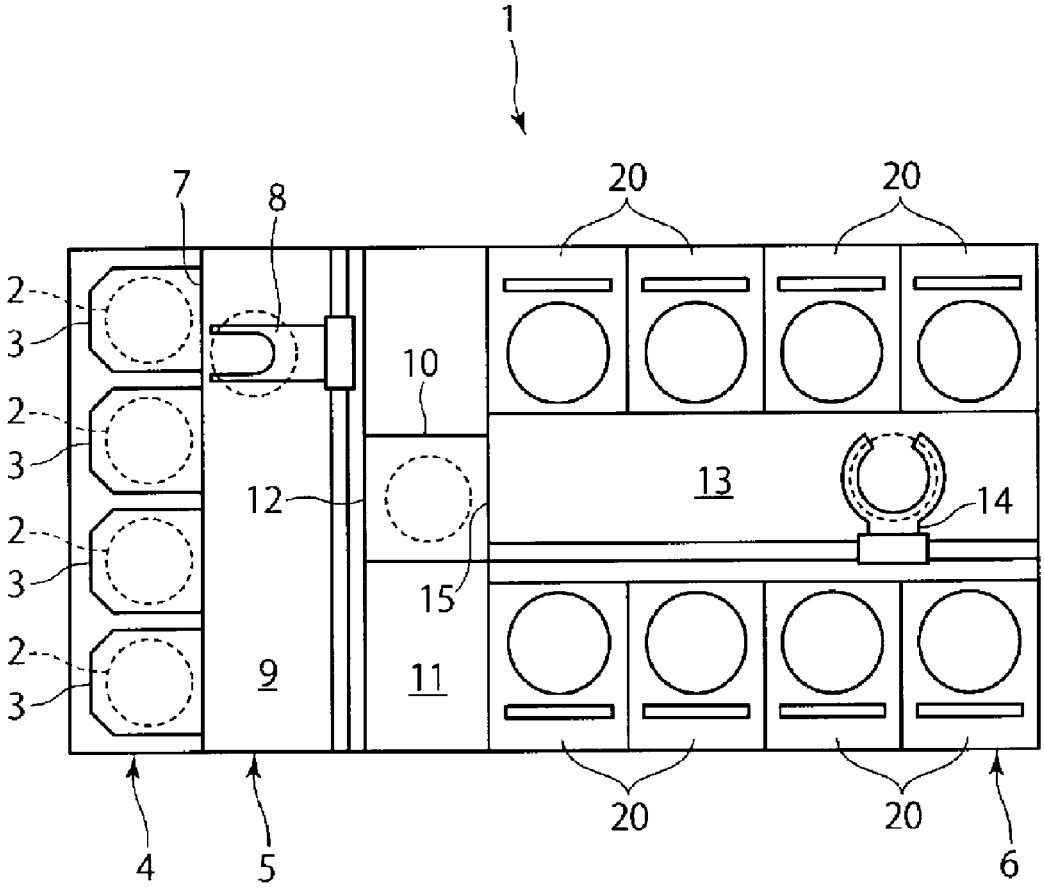
FIG. 1 is a plane view illustrating a schematic configuration of a plating system in accordance with an example embodiment.

As depicted in FIG. 1, the plating system 1 includes a substrate loading/unloading chamber 5 and a substrate processing chamber 6. The substrate loading/unloading chamber 5 is configured to mount thereon a carrier 3 accommodating a multiple number (e.g., 25 sheets) of substrates 2 (herein, semiconductor wafers), and is configured to load and unload the substrates 2 by a preset number. The substrate processing chamber 6 is configured to perform various processes such as a plating process and a cleaning process on the substrates 2. The substrate loading/unloading chamber 5 and the substrate processing chamber 6 are arranged adjacent to each other.

(Substrate Loading/Unloading Chamber)

The substrate loading/unloading chamber 5 includes a carrier mounting unit 4; a transfer chamber 9 accommodating therein a transfer device 8; and a substrate transit chamber 11 accommodating therein a substrate transit table 10. Within the substrate loading/unloading chamber 5, the transfer chamber 9 and the substrate transit chamber 11 are connected to and communicate with each other via a transit opening 12. The carrier mounting unit 4 mounts thereon a multiple number of carriers 3, and each of the carriers 3 accommodates therein a multiple number of substrates 2 while holding the substrates 2 horizontally. In the transfer chamber 9, the substrates 2 are transferred, and in the substrate transit chamber 11, the substrates 2 are transited to and from the substrate processing chamber 6.

In this substrate loading/unloading chamber 5, the substrates 2 are transferred by the transfer device 8 between a single carrier 3 mounted on the carrier mounting unit 4 and the substrate transit table 10 by a preset number.

(Substrate Processing Chamber)

The substrate processing chamber 6 includes a substrate transfer unit 13 extended in a forward-backward direction (left-right direction in FIG. 1) at a central portion thereof; and a multiple number of plating apparatuses 20 arranged side by side in the forward-backward direction at two opposite sides of the substrate transfer unit 13 and configured to perform a plating process by supplying a plating liquid onto the substrates 2.

The substrate transfer unit 13 includes a substrate transfer device 14 configured to be movable in the forward-backward direction. Further, the substrate transfer unit 13 communicates with the substrate transit table 10 of the substrate transit chamber 11 via a substrate loading/unloading opening 15.

In this substrate processing chamber 6, the substrates 2 are transferred into each of the plating apparatuses 20 one by one by the substrate transfer device 14 of the substrate transfer unit 13 while held on the substrate transfer device 14 horizontally. Further, in each of the plating apparatuses 20, a cleaning process and a plating process are performed on the substrates 2 one by one.

Except that the respective plating apparatuses 20 use different kinds of plating liquids, the respective plating apparatuses 20 have substantially the same configuration. Thus, hereinafter, a configuration of a single plating apparatus 20 among the multiple number of plating apparatuses 20 will be explained on behalf of the others.

(Plating Apparatus)

Figure 2:
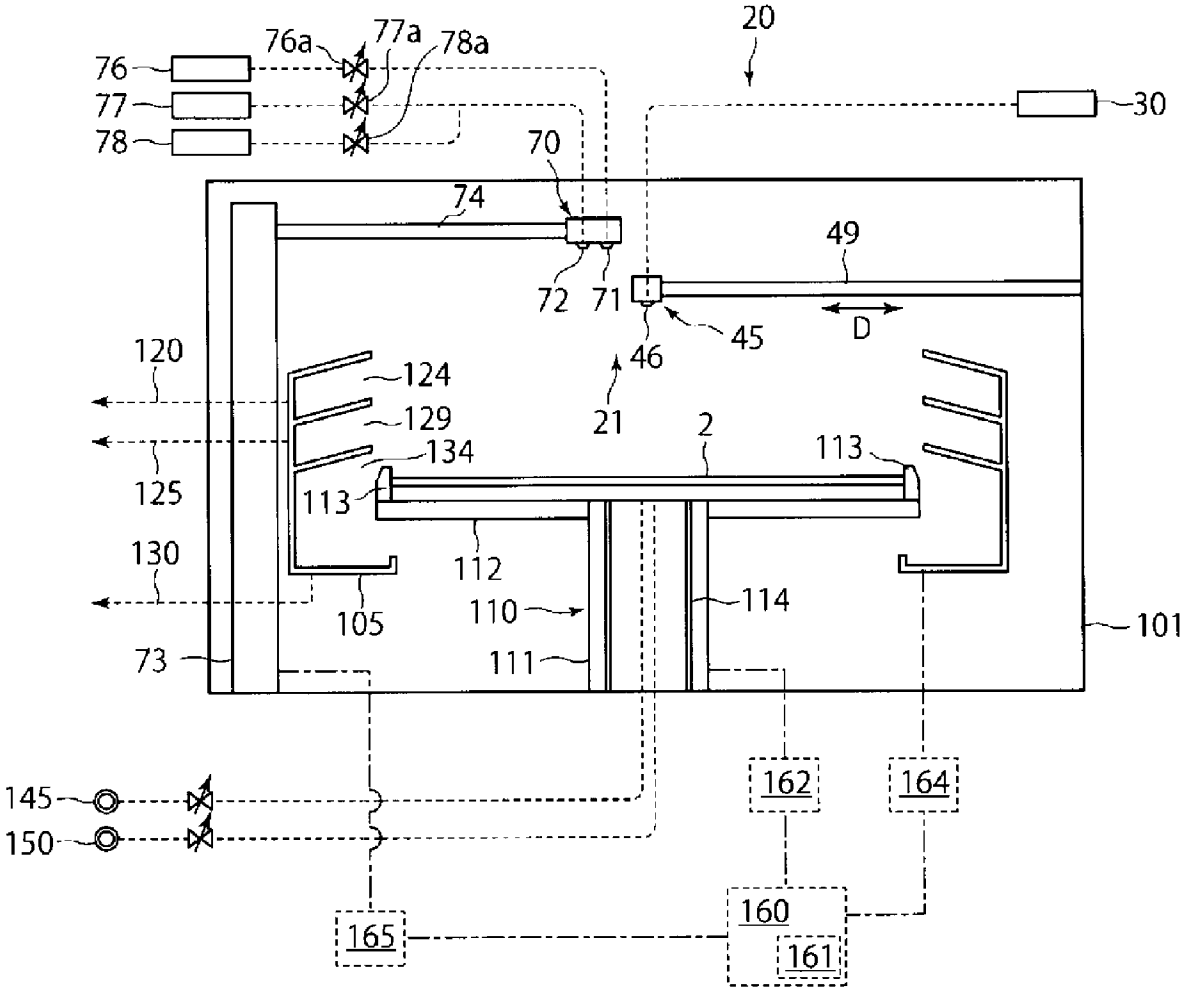
FIG. 2 is a side view illustrating a plating apparatus in accordance with the example embodiment.
Figure 3:
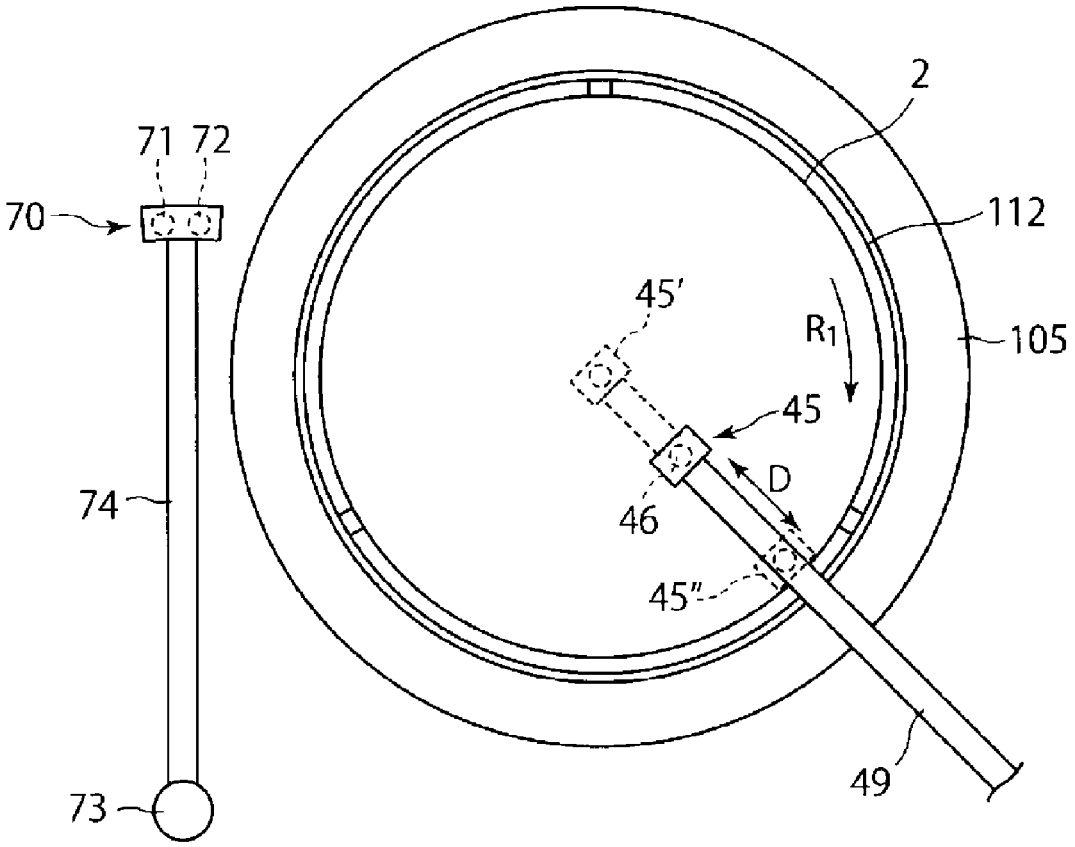
FIG. 3 is a plane view of the plating apparatus shown in FIG. 2.

Below, referring to FIG. 2 and FIG. 3, the plating apparatus 20 will be described. FIG. 2 and FIG. 3 are a side view and a plane view illustrating the plating apparatus 20, respectively.

The plating apparatus 20 includes, as illustrated in FIG. 2 and FIG. 3, a substrate holding/rotating device 110 configured to hold and rotate a substrate 2 within a casing 101; a discharging device 21 configured to discharge a plating liquid toward a surface of the substrate 2 held on the substrate holding/rotating device 110; a plating liquid supplying device 30 configured to supply the plating liquid to the discharging device 21; liquid draining devices 120, 125 and 130 configured to drain the plating liquid dispersed from the substrate 2 and collected in draining openings 124, 129 and 134 of a cup 105 which is configured to be move up and down by an elevating device 164; and a controller 160 configured to control the substrate holding/rotating device 110, the discharging device 21 and the plating liquid supplying device 30.

(Substrate Holding/Rotating Device)

The substrate holding/rotating device 110 includes, as illustrated in FIG. 2 and FIG. 3, a hollow cylindrical rotation shaft 111 vertically extended within the casing 101; a turntable 112 provided at an upper end portion of the rotation shaft 111; a wafer chuck 113 disposed on a peripheral portion of a top surface of the turntable 112 to support the substrate 2; and a rotating device 162 configured to rotate the rotation shaft 111. The rotating device 162 is controlled by the controller 160, and the rotation shaft 111 is rotated by the rotating device 162. As a result, the substrate 2 supported on the wafer chuck 113 is rotated. In this case, the controller 160 controls the rotating device 162 to rotate the rotation shaft 111 and the wafer chuck 113 or stop the rotation thereof. Further, the controller 160 can increase or decrease a rotational speed of the rotation shaft 111 and the wafer chuck 113 or can allow the rotational speed of the rotation shaft 111 and the wafer chuck 113 to be constant.

(Discharging Device)

Now, the discharging device 21 configured to discharge a plating liquid or the like toward the substrate 2 will be elaborated. The discharging device 21 includes a first discharge nozzle 45 which are configured to discharge a plating liquid for chemical reduction plating, such as a CoP plating liquid, toward the substrate 2. The plating liquid for the chemical reduction plating is supplied to the first discharge nozzle 45 from the plating liquid supplying device 30. Details of the first discharge nozzle 45 will be elaborated later. Further, though only one first discharge nozzle 45 is illustrated in FIG. 2, it may be also possible to provide, in addition to the first discharge nozzle 45, one or more other discharge nozzles (additional discharge nozzles) configured to discharge a plating liquid for the chemical reduction plating, such as a CoP plating liquid, toward the substrate 2.

The discharging device 21 may further include, as illustrated in FIG. 2, a second discharge nozzle 70 having a discharge opening 71 and a discharge opening 72. As depicted in FIG. 2 and FIG. 3, the second discharge nozzle 70 is provided at a leading end portion of an arm 74. The arm 74 is fastened to a supporting shaft 73 which is configured to be extended in a vertical direction and rotated by a rotating device 165.

The discharge opening 71 of the second discharge nozzle 70 is connected via a valve 76*a* to a plating liquid supplying device 76 configured to supply a plating liquid for displacement plating such as a Pd plating liquid. The discharge opening 72 is connected via a valve 77*a* to a cleaning liquid supplying device 77 configured to supply a cleaning liquid. By providing the second discharge nozzle 70 having the above-described configuration, it is possible to perform a plating process by using the plating liquid for the displacement plating and a cleaning process as well as a plating process by using the plating liquid for the chemical reduction plating within a single plating apparatus 20.

Further, as depicted in FIG. 2, a rinse liquid supplying device 78 configured to supply a pre-treatment liquid for performing a pre-treatment prior to a plating process, e.g., a rinse liquid such as pure water, may also be further connected to the discharge opening 72 of the second discharge nozzle 70 via a valve 78*a*. In this configuration, by controlling opening and closing of the valves 77*a* and 78*a* appropriately, either one of the cleaning liquid and the rinse liquid may be selectively discharged onto the substrate 2 from the second discharge nozzle 70.

(First Discharge Nozzle)

Now, the first discharge nozzle 45 will be elaborated. As depicted in FIG. 2 and FIG. 3, the first discharge nozzle 45 includes a discharge opening 46. Further, the first discharge nozzle 45 is provided at a leading end portion of an arm 49, and the arm 49 is configured to be movable back and forth in the radial direction of the substrate 2 (i.e., in a direction indicated by an arrow D in FIG. 2 and FIG. 3). Accordingly, the first discharge nozzle 45 is configured to be movable between a central position near the central portion of the substrate 2 and a peripheral position outer than the central position. In FIG. 3, the first discharge nozzle at the central position is indicated by a reference numeral 45', and the first discharge nozzle at the peripheral position is indicated by a reference numeral 45".

(Plating Liquid Supplying Device)

Figure 4:
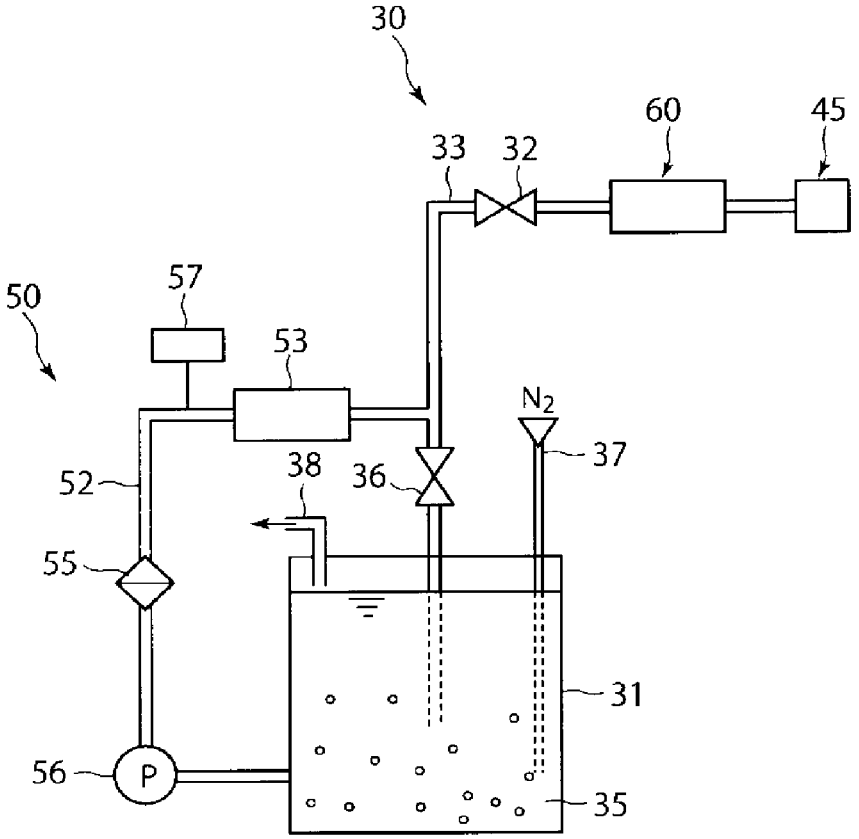
FIG. 4 is a diagram illustrating a plating liquid supplying device.

Now, the plating liquid supplying device 30 configured to supply the plating liquid for the chemical reduction plating, such as the CoP plating liquid, to the first discharge nozzle 45 of the discharging device 21 will be described. FIG. 4 illustrates the plating liquid supplying device 30.

As illustrated in FIG. 4, the plating liquid supplying device 30 includes a supply tank 31 configured to store therein the plating liquid 35; and a supply line 33 configured to supply the plating liquid 35 of the supply tank 31 to the first discharge nozzle 45. A valve 32 is provided at the supply line 33.

Further, as depicted in FIG. 4, a tank heating unit 50 configured to heat the plating liquid 35 to a storage temperature is provided at the supply tank 31. Further, a heating unit 60 configured to heat the plating liquid 35 to a discharge temperature higher than the storage temperature is provided at the supply line 33 between the tank heating unit 50 and the first discharge nozzle 45. The tank heating unit 50 and the heating unit 60 will be described later in detail.

The aforementioned "storage temperature" is set to be a certain temperature higher than a room temperature and lower than a temperature (plating temperature) at which precipitation of metal ions progresses through self-reaction within the plating liquid 35. Further, the "discharge temperature" is set to be certain temperatures equal to or higher than the plating temperature. In accordance with the present example embodiment, the plating liquid 35 is heated to a temperature equal to or higher than the plating temperature through two stages.

Accordingly, as compared to a case where the plating liquid 35 is heated to a temperature equal to or higher than the plating temperature within the supply tank 31, it is possible to suppress deactivation of a reducing agent in the plating liquid 35 or evaporation of a component of the plating liquid 35 within the supply tank 31. Therefore, a decrease of lifetime of the plating liquid 35 can be suppressed. Further, as compared to a case where the plating liquid 35 is stored at the room temperature within the supply tank 31 and later heated to a temperature equal to or higher than the plating temperature by the heating unit 60, it is possible to heat the plating liquid 35 to the temperature equal to or higher than the plating temperature promptly with low energy. Accordingly, precipitation of metal ions can be suppressed.

Various kinds of chemical liquids are supplied into the supply tank 31 from a multiple number of chemical liquid supplying sources (not illustrated) in which various kinds of components of the plating liquid 35 are stored. By way of non-limiting example, chemical liquids such as a $CoSO_4$ metal salt containing Co ions, a reducing agent (e.g., hypophosphorous acid, etc.) and an additive are supplied in the supply tank 31. Here, flow rates of the various kinds of the chemical liquids are controlled so that the components of the plating liquid 35 stored in the supply tank 31 are appropriately adjusted.

(Tank Heating Unit)

The tank heating unit 50 includes, as illustrated in FIG. 4, a circulating line 52 serving as a circulation path of the plating liquid 35 in the vicinity of the supply tank 31; a heater 53 provided at the circulating line 52 and configured to heat the plating liquid 35 to the storage temperature; and a pump 56 provided at the circulating line 52 and configured to circulate the plating liquid 35. By providing the tank heating unit 50, it is possible to heat the plating liquid 35 within the supply tank 31 to the aforementioned storage temperature while circulating the plating liquid 35 in the vicinity of the supply tank 31.

Further, as illustrated in FIG. 4, the supply line 33 is connected to the circulating line 52. In the shown example, when a valve 36 is opened and the valve 32 is closed, the plating liquid 35 having passed through the heater 53 is returned back into the supply tank 31. Meanwhile, when the valve 36 is closed and the valve 32 is opened, the plating liquid 35 having passed through the heater 53 is introduced into the first discharge nozzle 45.

Moreover, as illustrated in FIG. 4, a filter 55 may be provided at the circulating line 52. With this configuration, when heating the plating liquid 35 by the tank heating unit 50, various kinds of impurities included in the plating liquid 35 can be removed. Furthermore, as depicted in FIG. 4, a monitoring unit 57 configured to monitor characteristics of the plating liquid 35 may be provided at the circulating line 52. The monitoring unit 57 may be implemented by a temperature monitor configured to monitor the temperature of the plating liquid 35, a pH monitor configured to monitor a pH value of the plating liquid 35, or the like.

As illustrated in FIG. 4, the plating liquid supplying device 30 may further include a degassing unit 37 connected to the supply tank 31 and configured to remove dissolved oxygen and dissolved hydrogen in the plating liquid 35 stored in the supply tank 31. The degassing unit 37 may be configured to supply an inert gas such as nitrogen into the supply tank 31. In this case, by dissolving the inert gas such as nitrogen in the plating liquid 35, the other gases such as the oxygen or the hydrogen already dissolved in the plating liquid 35 can be removed from the plating liquid 35. The oxygen or hydrogen removed from the plating liquid 35 is exhausted out of the supply tank 31 by an exhaust unit 38.

(Heating Unit)

Figure 5:
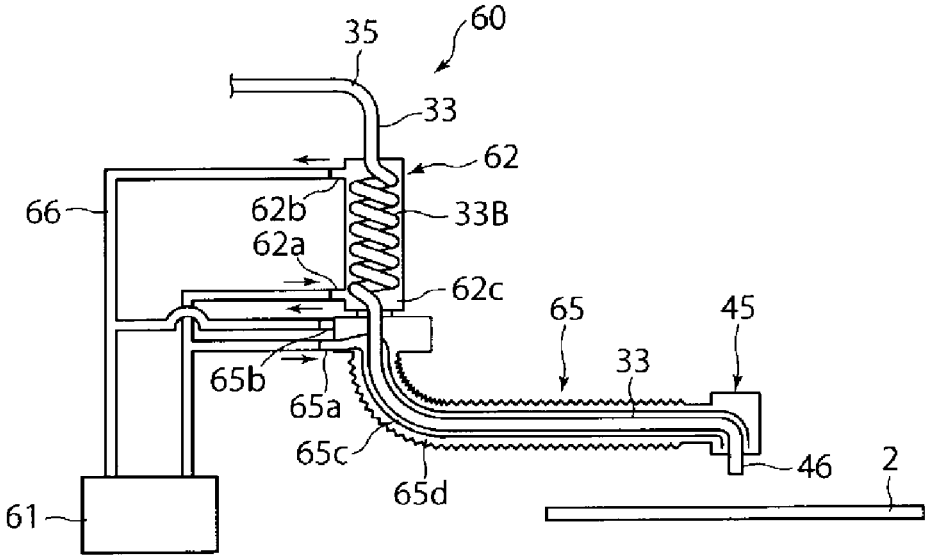
FIG. 5 is a diagram illustrating a heating unit of the plating liquid supplying device.

Now, referring to FIG. 5, the heating unit 60 will be elaborated. The heating unit 60 is configured to further heat the plating liquid 35, which is heated to the storage temperature by the tank heating unit 50, to the discharge temperature. The heating unit 60 includes, as illustrated in FIG. 5, a temperature medium supplying unit 61 and a temperature controller 62. The temperature medium supplying unit 61 is configured to heat a certain heat transfer medium to the discharge temperature or a temperature higher than the discharge temperature. The temperature controller 62 is provided at the supply line 33 and configured to transfer heat of the heat transfer medium from the temperature medium supplying unit 61 to the plating liquid 35 within the supply line 33. Further, as illustrated in FIG. 5, the heating unit 60 may further include a temperature maintaining unit 65 extended to an inside of the first discharge nozzle 45 and configured to maintain the temperature of the plating liquid 35 passing through the supply line 33 located within the first discharge nozzle 45 at the discharge temperature.

The temperature controller 62 includes a supply opening 62*a* through which the heat transfer medium (e.g., hot water) for temperature control is introduced from the temperature medium supplying unit 61; and a draining opening 62*b* through which the heat transfer medium is discharged out. The heat transfer medium supplied through the supply opening 62*a* comes into contact with the supply line 33 while the heat transfer medium flows in a space 62*c* within the temperature controller 62. With this configuration, the plating liquid 35 flowing through the supply line 33 is heated to the discharge temperature. After used for heating the plating liquid 35, the heat transfer medium is discharged out through the draining opening 62*b*.

Desirably, the supply line 33 within the temperature controller 62 may be formed to have a spiral shape, as illustrated in FIG. 5. Accordingly, a contact area between the heat transfer medium and the supply line 33 can be increased, so that the heat of the heat transfer medium can be transferred to the plating liquid 35 efficiently.

The temperature maintaining unit 65 is configured to maintain, before the plating liquid 35 heated to the discharge temperature by the temperature controller 62 is discharged from the first discharge nozzle 45, the temperature of the plating liquid 35. The temperature maintaining unit 65 includes, as illustrated in FIG. 5, a heat insulation pipe 65*c* extended to be in contact with the supply line 33 within the temperature maintaining unit 65; a supply opening 65*a* through which the heat transfer medium supplied from the temperature medium supplying unit 61 is introduced into the heat insulation pipe 65*c;* and a draining opening 65*b* through which the heat transfer medium is discharged. The heat insulation pipe 65*c* is extended to the vicinity of a leading end portion of the first discharge nozzle 45 along the supply line 33. With this configuration, the temperature of the plating liquid 35 discharged from the discharge openings 46 of the first discharge nozzle 45 can be uniformly maintained at the discharge temperature.

As shown in FIG. 5, the heat insulation pipe 65*c* may be opened within the first discharge nozzle 45, while communicating with a space 65*d* within the temperature maintaining unit 65. In this configuration, the temperature maintaining unit 65 may have a triple structure (triple-pipe structure) including the supply line 33 located at a central portion of a cross section thereof; the heat insulation pipe 65*c* surrounding the supply line 33 to be thermally in contact with the supply line 33; and the space 65*d* surrounding the heat insulation pipe 65*c*. The heat transfer medium introduced through the supply opening 65*a* serves to maintain the temperature of the plating liquid 35 through the heat insulation pipe 65*c* until the heat transfer medium reaches the leading end portion of the first discharge nozzle 45. Then, the heat transfer medium is discharged from the draining opening 65*b* after passing through the space 65*d* within temperature maintaining unit 65. The heat transfer medium flowing in the space 65*d* serves to thermally isolate the heat transfer medium flowing in the heat insulation pipe 65*c* (and the plating liquid 35 flowing in the supply line 33 inside the heat insulation pipe 65*c*) from the atmosphere outside the temperature maintaining unit 65. Accordingly, a heat loss of the heat transfer medium flowing in the heat insulation pipe 65*c* can be suppressed, and the heat may be efficiently transferred from the heat transfer medium flowing in the heat insulation pipe 65*c* to the plating liquid 35 flowing in the supply line 33.

FIG. 5 illustrates an example where the heat transfer medium supplied into the temperature controller 62 and the heat transfer medium supplied into the temperature maintaining unit 65 are commonly supplied from the temperature medium supplying unit 61. However, the example embodiment may not be limited thereto, and the heat transfer medium supplied into the temperature controller 62 and the heat transfer medium supplied into the temperature maintaining unit 65 may be supplied from individual heat transfer medium supplying sources.

(Liquid Draining Device)

Now, the liquid draining devices 120, 125 and 130 configured to drain the plating liquid or the cleaning liquid dispersed from the substrate 2 will be elaborated with reference to FIG. 2. As shown in FIG. 2, the cup 105 capable of being moved up and down by the elevating device 164 and having the draining openings 124, 129 and 134 is disposed within the casing 101. The liquid draining devices 120, 125 and 130 are configured to drain the liquids collected in the draining openings 124, 129 and 134, respectively.

The processing liquids dispersed from the substrate 2 are drained by the liquid draining devices 120, 125 and 130 through the draining openings 124, 129 and 134, respectively, while separated by their kinds. By way of example, the CoP plating liquid dispersed from the substrate 2 may be drained by the plating liquid draining device 120; the Pd plating liquid dispersed from the substrate 2 may be drained by the plating liquid draining device 125; and the cleaning liquid or the rinse liquid dispersed from the substrate 2 may be drained by the processing liquid draining device 130.

(Other Constituent Components)

As shown in FIG. 2, the plating apparatus 20 may further include a rear surface processing liquid supplying device 145 configured to supply a processing liquid to a rear surface of the substrate 2; and a rear surface gas supplying device 150 configured to supply a gas to the rear surface of the substrate 2.

The plating system 1 including the multiple number of plating apparatuses 20 having the above-described configuration is controlled by the controller 160 according to various kinds of programs recorded on a storage medium 161 provided in the controller 160. Therefore, various processes are performed on the substrate 2. Here, the storage medium 161 stores thereon various kinds of setup data or various kinds of programs such as a plating program to be described later. The storage medium 161 may be implemented by a computer-readable memory such as a ROM or a RAM, or a disk-type storage medium such as a hard disk, a CD-ROM, DVD-ROM or a flexible disk, as commonly known in the art.

(Plating Method)

In the present example embodiment, the plating system 1 and the plating apparatus 20 are controlled by the controller 160 to perform a plating process on the substrate 2 according to a plating program recorded on the storage medium 161. In the following description, a method of performing a Pd plating process on the substrate 2 by the displacement plating and then performing a Co plating process by the chemical reduction plating in a single plating apparatus 20 will be explained with reference to FIG. 6 to FIG. 8.

(Substrate Loading Process and Substrate Receiving Process)

First, a substrate loading process and a substrate receiving process are performed. A single sheet of substrate 2 is loaded into the one plating apparatus 20 from the substrate transit chamber 11 by the substrate transfer device 14 of the substrate transfer unit 13. In the plating apparatus 20, the cup 105 is lowered to a preset position, and the loaded substrate 2 is held by the wafer chuck 113. Then, the cup 105 is raised by the elevating device 164 up to a position where an outer peripheral end portion of the substrate 2 faces the draining opening 134.

(Cleaning Process)

Thereafter, a cleaning process (block S301) including a rinse process, a pre-cleaning process and another rinse process is performed. First, the valve 78*a* of the rinse liquid supplying device 78 is opened, and a rinse liquid is supplied onto the surface of the substrate 2 through the discharge opening 72 of the second discharge nozzle 70. Then, a pre-cleaning process is performed. First, the valve 77*a* of the cleaning liquid supplying device 77 is opened, and a cleaning liquid is supplied onto the surface of the substrate 2 through the discharge opening 72 of the second discharge nozzle 70. Further, for example, malic acid may be used as the cleaning liquid, and pure water may be used as the rinse liquid. Thereafter, the rinse liquid is also supplied onto the surface of the substrate 2 through the discharge opening 72 of the second discharge nozzle 70 in the same manner as described above. The used rinse liquid and the used cleaning liquid are disposed of through the draining opening 134 of the cup 105 and the processing liquid draining device 130. Unless otherwise mentioned, in the cleaning process (block S301) and subsequent processes to be described below, the substrate 2 is being rotated in the first rotational direction $R_1$ by the substrate holding/rotating device 110.

(Pd Plating Process)

Subsequently, a Pd plating process (block S302) is performed. This Pd plating process (block S302) is performed as a displacement plating process while the substrate 2 is not yet dried after the cleaning process is completed. By performing the displacement plating process while the substrate 2 is not yet dried, it may be possible to avoid a case where the displacement plating process is not effectively performed since copper or the like on a plating target surface of the substrate 2 is oxidized.

In the Pd plating process, the cup 105 is lowered by the elevating device 164 to a position where the draining opening 129 and the outer peripheral end portion of the substrate 2 face each other. Then, the valve 76*a* of the plating liquid supplying device 76 is opened, and a Pd-containing plating liquid is discharged onto the surface of the substrate 2 through the discharge opening 71 of the second discharge nozzle 70 at a desired flow rate. As a result, Pd plating is performed on the surface of the substrate 2. The used plating liquid is drained out through the draining opening 129 of the cup 105. Thereafter, the used plating liquid drained out through the draining opening 129 is collected through the liquid draining device 125. Then, the plating liquid is reused or wasted.

(Rinse Process)

Thereafter, as a pre-treatment to be performed prior to the Co plating process, a rinse process (block S303) is performed, for example. By way of example, in the rinse process (block S303), the rinse liquid is supplied onto the surface of the substrate 2 as a pre-treatment liquid. Further, after the rinse process, the substrate 2 may be cleaned through a chemical liquid process using a chemical liquid. Thereafter, in order to remove the chemical liquid, another rinse process may be performed by using the rinse liquid.

(Co Plating Process)

Figure 6:
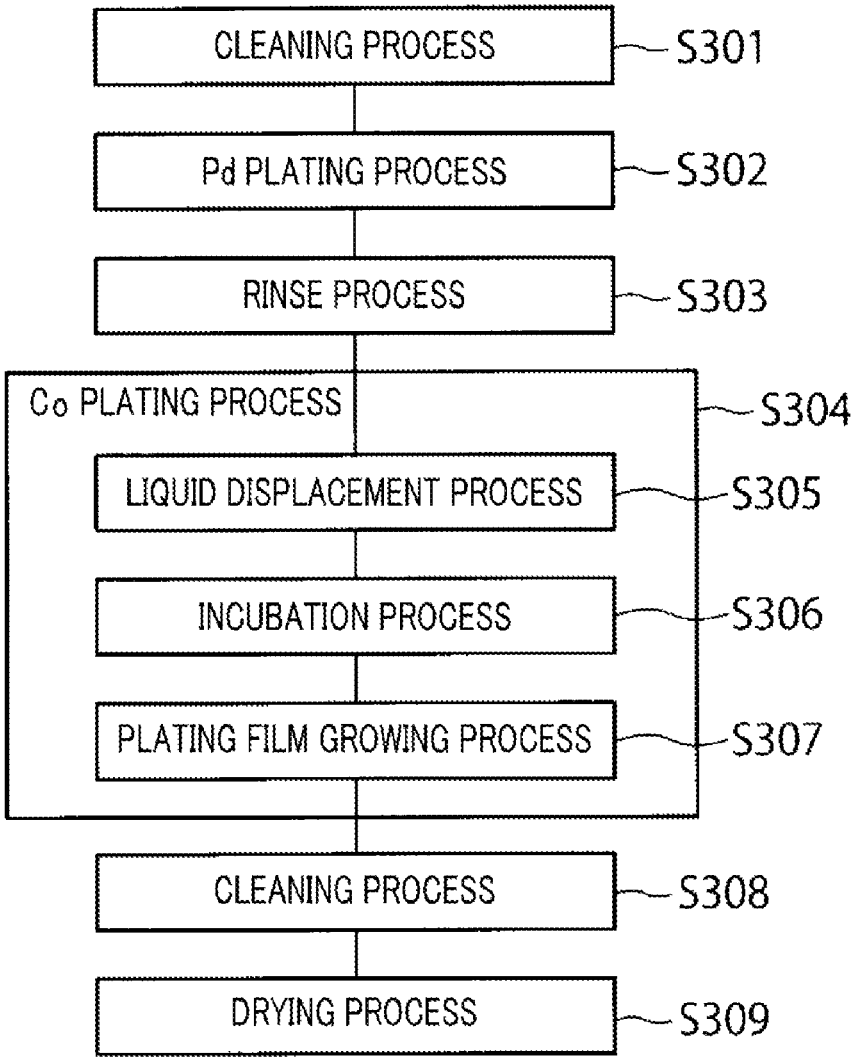
FIG. 6 is a flowchart for describing a plating method in accordance with the example embodiment.

Then, a Co plating process (block S304) is performed in the same plating apparatus 20 as used in performing the above-described processes (blocks S301 to S303). This Co plating process (block S304) is performed as a chemical reduction plating process. The Co plating process (block S304) includes, as shown in FIG. 6, a liquid displacement process (block S305) (first process), an incubation process (block S306) (second process) and a plating film growing process (block S307) (third process).

In the Co plating process, an element that is precipitated to form a plating layer may not be limited to Co, and another element may also be precipitated at the same time. By way of example, when a plating liquid used in the Co plating process contains not only Co ions but also ions of other element, Co and the other element may be precipitated concurrently. Here, description will be provided for a case where Co ions and P ions are contained in the plating liquid and, thus, a plating layer (CoP) containing P as well as Co is formed. In the following description, even if the element other than Co is contained in the plating layer, the plating layer obtained through the Co plating process will be referred to as a "Co plating layer."

Among the aforementioned processes (blocks S305 to S307), the liquid displacement process (block S305) is a process for displacing the rinse liquid (e.g., pure water) supplied on the substrate 2 in the rinse process (block S303) and remaining on the surface of the substrate 2 by the plating liquid 35 for forming CoP. The incubation process (block S306) is a process for forming an initial Co plating layer 84 on an entire region of a Pd plating layer 83 to be described later while continuously supplying the plating liquid 35 onto the substrate 2 after performing the liquid displacement process (block S305). Here, the initial Co plating layer 84 refers to a plating layer having a thickness in a range of, but not limited to, from several nanometers to several tens of nanometers. Further, the plating film growing process (block S307) is a process for forming the Co plating layer 84 having a sufficient thickness in a range of, but not limited to, from about 100 nanometers to about 1 micrometer by allowing the plating reaction to further progress on the initial Co plating layer 84 formed in the incubation process (block S306) while continuously supplying the plating liquid 35 onto the substrate 2.

Figure 7A:
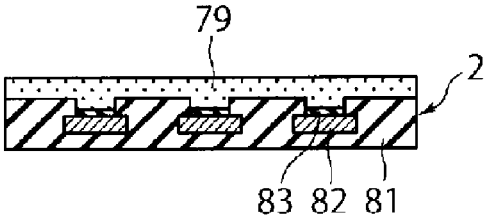
FIG. 7A to FIG. 7E are cross sectional views illustrating formation of a Co plating layer in a Co plating process.

Below, the Co plating process will be described in detail with reference to FIG. 7A to FIG. 7E and FIG. 8. FIG. 7A illustrates the substrate 2 after the Pd plating process (block S302) and the rinse process (block S303) are performed. As shown in FIG. 7A, the substrate 2 has an insulating layer 81 made of, e.g., an organic compound; and a wiring 82 made of, e.g., copper; and the Pd plating layer 83 that covers the wiring 82. Further, a rinse liquid 79 supplied in the rinse process (block S303) remains on the substrate 2.

(Liquid Displacement Process)

Figure 7B:
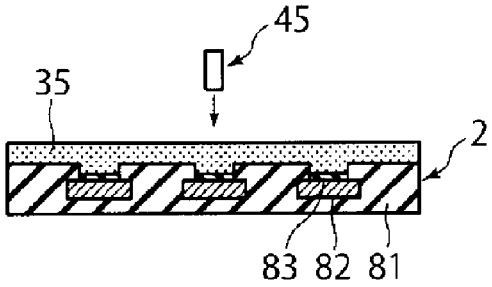
Figure 8:
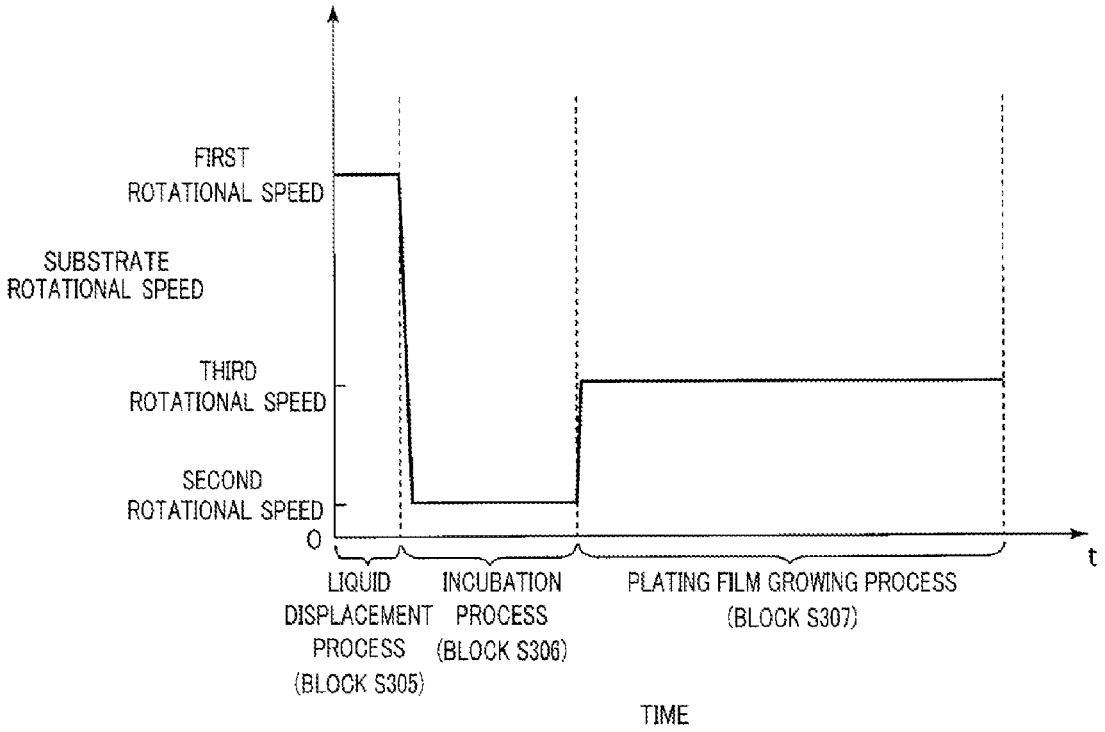
FIG. 8 is a graph showing a relationship between a rotational speed of a substrate and a time in a Co plating process.

First, the controller 160 controls the substrate holding/rotating device 110 to rotate the substrate 2 held on the substrate holding/rotating device 110 at a first rotational speed (FIG. 8). Here, the first rotational speed may be set to be in the range, but not limited to, from about 100 rpm to about 300 rpm. In this state, as shown in FIG. 7B, the plating liquid 35 heated to the discharge temperature by the heating unit 60 is discharged from the discharge opening 46 of the first discharge nozzle 45 toward the surface of the substrate 2. At this time, the plating liquid 35 discharged from the discharge opening 46 of the first discharge nozzle 45 reaches the substantially central portion of the substrate 2.

By discharging the plating liquid 35 toward the substrate 2 by using the first discharge nozzle 45, the rinse liquid 79 existing on the substrate 2 is displaced by the plating liquid 35 for forming CoP, as illustrated in FIG. 7B. Then, the liquid displacement process (block S305) is completed. Although varied depending on a size of the substrate 2 or a flow rate of the plating liquid 35, a time required for the liquid displacement process (block S305) may be in the range of, but not limited to, from about 1 second to about 2 minutes. Further, at this time, by horizontally moving (scanning) the first discharge nozzle 45 from the central portion of the substrate 2 toward the peripheral portion of the substrate 2, the rinse liquid 79 may be efficiently washed off the surface of the substrate 2.

(Incubation Process)

Subsequently, while continuously supplying the plating liquid 35 onto the substrate 2 by using the first discharge nozzle 45, the controller 160 controls the substrate holding/rotating device 110. That is, the rotation of the substrate 2 held on the substrate holding/rotating device 110 is stopped, or the substrate 2 is rotated at a second rotational speed lower than the first rotational speed (FIG. 8). During this process, a puddle (an accumulation) of the plating liquid 35 is formed on the substrate 2, and an initial Co plating film is formed on the Pd plating layer 83 on the surface of the substrate 2.

Figure 7C:
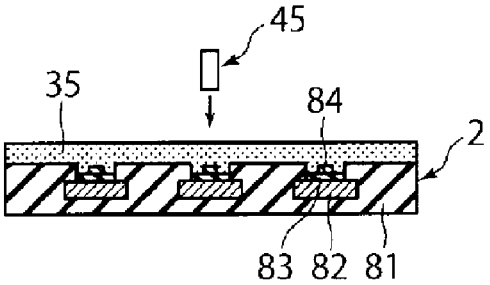
Figure 7D:
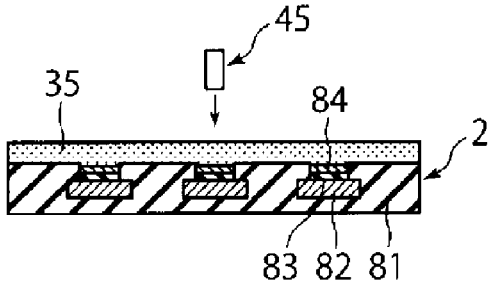

That is, while continuously discharging the plating liquid 35 toward the substrate 2 by using the first discharge nozzle 45, as depicted in FIG. 7C, the initial Co plating layer 84 is partially formed on the Pd plating layer 83. While discharging the plating liquid 35 toward the substrate 2, the initial Co plating layer 84 is formed on the entire region of the Pd plating layer 83, as shown in FIG. 7D. That is, the Co plating layer 84 having a thickness in the range of, but not limited to, from several nanometers to several tens of nanometers is formed on the Pd plating layer 83. Then, the incubation process (block S306) is completed.

Further, a time required for the incubation process (block S306) is set to be longer than a time required for the liquid displacement process (block S305). Desirably, the time for the incubation process (block S306) may be set to be in the range, but not limited to, from about 10 seconds to about 10 minutes.

Moreover, in the incubation process (block S306), when supplying the plating liquid 35 onto the substrate 2, the first discharge nozzle 45 may be stopped at the central position near the central portion of the substrate 2 or may be moved horizontally between the central position (indicated by a reference numeral 45' in FIG. 3) near the central portion of the substrate 2 and the peripheral position (indicated by a reference numeral 45" in FIG. 3) outer than the central position. By way of example, the plating liquid 35 may be discharged from the first discharge nozzle 45 toward the substrate 2 while the first discharge nozzle 45 is being moved from the peripheral position to the central position. In such a case, the plating liquid 35 discharged from the first discharge nozzle 45 may collide with the plating liquid 35 that already exists on the substrate 2. As a result, a flow of the plating liquid 35 may be stagnated, so that a liquid accumulation portion of the plating liquid 35 may be formed on the substrate 2. By forming this liquid accumulation portion of the plating liquid, formation of the initial Co plating layer 84 on the Pd plating layer 83 can be accelerated.

As shown in FIG. 8, in the incubation process (block S306), the rotation of the substrate 2 is stopped or the substrate 2 is rotated at the second rotational speed lower than the first rotational speed (i.e., the first rotational speed>the second rotational speed), as described above. The reason for stopping the rotation of the substrate 2 or rotating the substrate 2 at a lower speed is as follows. When forming the Co plating layer 84 on the Pd plating layer 83, which is made of a different material from that of the Co plating layer 84, if the movement of the plating liquid 35 is large at the initial stage of the film formation, it may impede the formation of the Co plating layer 84. Thus, the movement of the plating liquid 35 needs to be reduced by stopping the rotation of the substrate 2 or rotating the substrate 2 at a lower speed. Here, the second rotational speed may be set to be in the range, but not limited to, from about 0 rpm to about 30 rpm.

(Plating Film Growing Process)

Subsequently, while continuously supplying the plating liquid 35 onto the substrate 2 by using the first discharge nozzle 45, the controller 160 controls the substrate holding/rotating device 110 to rotate the substrate 2 held on the substrate holding/rotating device 110 at a third rotational speed (FIG. 8). As a result, the Co plating layer 84 more grows on the surface of the substrate 2.

Figure 7E:
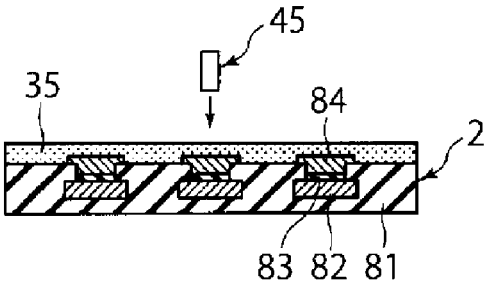

That is, while continuously discharging the plating liquid 35 toward the substrate 2 by using the first discharge nozzle 45, as illustrated in FIG. 7E, the thickness of the Co plating layer 84 on the Pd plating layer 83 reaches a preset thickness, e.g., about 1 μm. Then, the plating film growing process (block S307) is completed. Further, a time required for the plating film growing process (block S307) is set to be longer than the time for the liquid displacement process (block S305) and the time for the incubation process (block S306). By way of example, but not limitation, the time required for the plating film growing process (block S307) may be set to be in the range, e.g., from about 1 minute to about 20 minutes.

Furthermore, in the plating film growing process (block S307), when supplying the plating liquid 35 onto the substrate 2, the first discharge nozzle 45 may be stopped at the central position near the central portion of the substrate 2 or may be moved between the central position (indicated by the reference numeral 45' in FIG. 3) near the central portion of the substrate 2 and the peripheral position (indicate by the reference numeral 45" in FIG. 3) outer than the central position. By way of example, the controller 160 controls the first discharge nozzle 45 and the arm 49 to allow the first discharge nozzle 45 to discharge the plating liquid 35 toward the substrate 2 while the first discharge nozzle 45 is being moved from the peripheral position to the central position. Through this control, the growth of the Co plating layer 84 in the plating film growing process (block S307) can be further accelerated.

As depicted in FIG. 8, in the plating film growing process (block S307), the third rotational speed of the substrate 2 is set to be higher than the second rotational speed and lower than the first rotational speed (i.e., the first rotational speed>the third rotational speed>the second rotational speed). The reason for rotating the substrate 2 at the rotational speed (third rotational speed) higher than the rotational speed (second rotational speed) in the incubation process (block S306) is as follows. When the Co plating layer 84 grows, a concentration of reactive species in the plating liquid 35 on the surface of the Co plating layer 84 gradually decreases. To solve this problem, as in the present example embodiment, by rotating the substrate 2 at a rotational speed higher than that in the incubation process (block S306), the plating liquid 35 is allowed to be moved on the surface of the Co plating layer 84. Accordingly, it is possible to displace the plating liquid 35, in which a concentration of the reactive species is reduced, by a new plating liquid 35 and suppress a decrease of the concentration of the reactive species in the plating liquid 35. As a result, the stable growth of the plating film can be accelerated. Further, by rotating the substrate 2 at the rotational speed higher than that in the incubation process (block S306), it may be also possible to efficiently remove impurities or the like generated on the surface of the substrate 2. Here, the third rotational speed may be set to be in the range, but not limited to, from about 30 rpm to about 100 rpm.

Moreover, in the plating film growing process (block S307), the substrate 2 need not continuously be rotated at the constant rotational speed, and the rotational speed of the substrate 2 may be temporarily decreased or the rotation of the substrate 2 may be temporarily stopped. If the third rotational speed is set to be excessively low, however, the above-described effect of suppressing a decrease of the concentration of the reactive species in the plating liquid 35 and thus accelerating the stable growth of the plating film may not be obtained. Meanwhile, if the third rotational speed is set to be excessively high, for example, over the first rotational speed, the Co plating layer 84 may not be grown uniformly on the entire surface of the substrate 2.

In the Co plating process (block S304), the cup 105 is lowered by the elevating device 164 to a position where the draining opening 124 and the outer peripheral end portion of the substrate 2 face each other. Accordingly, the used plating liquid 35 is drained out through the draining opening 124 of the cup 105. After drained, the used plating liquid 35 is collected through the liquid draining device 120 and, then, reused or wasted.

In this way, the Co plating process (block S304) including the liquid displacement process (block S305) (first process), the incubation process (block S306) (second process) and the plating film growing process (block S307) (third process) is completed.

(Cleaning Process)

Thereafter, a cleaning process (block S308) including a rinse process, a post-cleaning process and another rinse process is performed on the surface of the substrate 2 on which the Co plating process has been performed. Since the cleaning process (block S308) is substantially the same as the above-described cleaning process (block S301), detailed elaboration thereof will be omitted.

(Drying Process)

Then, a drying process (block S309) for drying the substrate 2 is performed. By way of example, by rotating the turntable 112, the liquid adhering to the substrate 2 may be dispersed outward by a centrifugal force, so that the substrate 2 may be dried. That is, the turntable 112 may serve as a drying device configured to dry the surface of the substrate 2.

As discussed above, in the single plating apparatus 20, the Pd plating is first performed on the surface of the substrate 2 by the displacement plating, and the Co plating is then performed by the chemical reduction plating.

Thereafter, the substrate 2 may be transferred into another plating apparatus 20 for Au plating.

In this another plating apparatus 20, an Au plating process is performed on the surface of the substrate 2 by the displacement plating. Except that a plating liquid and a cleaning liquid different from those of the Pd plating process are used, the method of the Au plating is substantially the same as that of the Pd plating process as described above. Thus, detailed description thereof will be omitted here.

(Effects of Example Embodiment)

In accordance with the example embodiment, as described above, in the state that the rinse liquid remains on the surface of the substrate 2, the liquid displacement is performed by supplying the plating liquid 35 onto the substrate 2 while rotating the substrate 2 at the first rotational speed (liquid displacement process (block S305)). Subsequently, while continuously supplying the plating liquid 35 onto the substrate 2, the substrate 2 is stopped or rotated at the second rotational speed, so that the initial plating film is formed on the substrate 2 (incubation process (block S306)). Thereafter, while continuously supplying the plating liquid 35 onto the substrate 2, the substrate is rotated at the third rotational speed, so that the plating film grows (plating film growing process (block S307)). Here, the first rotational speed is set to be higher than the third rotational speed, and the third rotational speed is set to be higher than the second rotational speed. By way of non-limiting example, the first rotational speed may be set to be in the range from about 100 rpm to about 300 rpm; the second rotational speed may be set to be in the range from about 0 rpm to about 30 rpm; and the third rotational speed may be set to be in the range from about 30 rpm to about 100 rpm. Accordingly, particularly in the plating film growing process (block S307), it is possible to displace the plating liquid 35, in which a concentration of the reactive species is reduced, by a new plating liquid 35, so that the stable growth of the plating film can be accelerated. As a result, a plating time for a single substrate can be shortened.

Further, the present example embodiment has been described for the case where the CoP plating liquid is used as the plating liquid 35 for the chemical reduction plating discharged toward the substrate 2 from the first discharge nozzle 45. However, the plating liquid 35 may not be limited to the CoP plating liquid, and various other kinds of plating liquids 35 can be employed. By way of non-limiting example, various plating liquids 35 such as a CoWB plating liquid, a CoWP plating liquid, a CoB plating liquid or a NiP plating liquid may be used as the plating liquid 35 for the chemical reduction plating.

We claim:

1. A plating method comprising:

a first material plating process of forming a first material layer on a substrate by supplying a first plating liquid onto the substrate;

a second material plating process of forming a second material layer on the first material layer, the second material layer being made of a different material from the first material layer;

wherein the second material plating process comprises:

an incubation process of forming a film on an entire region of the first material layer by supplying a second plating liquid onto the substrate while stopping the rotation of the substrate or rotating the substrate at a first rotational speed to reduce a movement of the second plating liquid;

after the completion of the incubation process, a growing process of growing the film in the growing process such that the grown film thickness increases by 10 times or more by continuously supplying the second plating liquid onto the substrate while increasing the first rotational speed of the substrate to a second rotational speed that is greater than the first rotational speed to replace the second plating liquid in which a concentration of a reactive species is reduced in the growing process with a new second plating liquid.

2. The plating method of claim 1, wherein the first rotational speed is in a range from about 0 rpm to about 30 rpm.

3. The plating method of claim 1, wherein the second rotational speed is in a range from about 30 rpm to about 100 rpm.

4. The plating method of claim 1, wherein the second plating liquid includes a CoP plating liquid, a CoWB plating liquid, a CoWP plating liquid, a CoB plating liquid or a NiP plating liquid.

5. The plating method of claim 1, wherein the second material plating process further comprises:

prior to the incubation process, a liquid displacement process of performing a liquid displacement by supplying the second plating liquid onto the substrate while rotating the substrate at a displacement rotational speed that is higher than the second rotational speed at the growing process in a state that a pre-treatment liquid remains on a surface of the substrate.

6. The plating method of claim 5, wherein the displacement rotational speed is in a range from about 100 rpm to about 300 rpm.

7. The plating method of claim 5, wherein a time for performing the incubation process is longer than a time for performing the liquid displacement process, and a time for performing the growing process is longer than the time for performing the incubation process.

8. The plating method of claim 5, wherein the first plating liquid and the second plating liquid are supplied onto the substrate by a discharge nozzle, and in the liquid displacement process, the discharge nozzle is moved from a central portion of the substrate toward a peripheral portion of the substrate.

9. A computer-readable storage medium having stored thereon computer-executable instructions that, in response to execution, cause a plating apparatus to perform a plating method, wherein the plating method comprises:

a first material plating process of forming a first material layer on a substrate by supplying a first plating liquid onto the substrate;

a second material plating process of forming a second material layer on the first material layer, the second material layer being made of a different material from the first material layer;

wherein the second material plating process comprises:

an incubation process of forming a film on an entire region of the first material layer by supplying a second plating liquid onto the substrate while stopping the rotation of the substrate or rotating the substrate at a first rotational speed to reduce a movement of the second plating liquid;

after the completion of the incubation process, a growing process of growing the film in the growing process such that the grown film thickness increases by 10 times or more by continuously supplying the second plating liquid onto the substrate while increasing the first rotational speed of the substrate to a second rotational speed that is greater than the first rotational speed to replace the second plating liquid in which a concentration of a reactive species is reduced in the growing process with a new second plating liquid.

* * * * *